United States Patent [19]

Bond

[11] Patent Number: 4,714,016

[45] Date of Patent: Dec. 22, 1987

[54] BUNDLING APPARATUS WITH FLEXIBLE ROPE TYPE COMPRESSOR

[76] Inventor: Joseph N. Bond, 28 Sarina Dr., Commack, N.Y. 11725

[21] Appl. No.: 929,742

[22] Filed: Nov. 10, 1986

[51] Int. Cl.[4] ..... B30B 5/04

[52] U.S. Cl. ..... 100/212; 100/32; 56/341; 56/430; 188/65.1; 188/82.1

[58] Field of Search ..... 188/67, 65.1, 82.1, 188/82.5, 30; 100/3, 31, 9, 34, 32, 212; 56/341, 432, 430

[56] References Cited

U.S. PATENT DOCUMENTS

| | | | |
|---|---|---|---|
| 489,980 | 1/1893 | Neale | 100/212 |
| 521,088 | 6/1894 | Ogle | 100/212 |
| 906,147 | 12/1908 | Miller et al. | 100/212 |
| 976,481 | 11/1910 | Lyon | 56/430 |
| 1,188,897 | 6/1916 | Case | 100/212 |
| 1,223,565 | 4/1917 | Curren | 100/212 |
| 3,742,842 | 7/1973 | Pierens | 100/212 |

*Primary Examiner*—Andrew M. Falik
*Attorney, Agent, or Firm*—Bucknam and Archer

[57] ABSTRACT

An arrangement for bundling elongated flexible elements includes a support which includes a hopper-shaped receptacle for supporting a plurality of the elements to be bundled with substantially the same orientation, and a base arranged underneath the receptacle. An elongated torque member is mounted in the base for rotation about an axis and it can be rotated by a hand crank mounted on the torque member for joint rotation therewith. At least one elongated flexible bundling member is provided, and it has two end portions with effective lengths that are at least sufficient for the end portions jointly to surround the plurality of the elements to be bundled, and a central portion interconnecting the end portions and connected to the torque member for becoming wound around the torque member during the rotation thereof with attendant simultaneous reduction in the effective lengths of the end portions. The end portions of the bundling rope are connected with one another by a buckle-type connecting device including an eyelet and a hook engageable in the eyelet, so that the end portions compress the elements being bundled into a compact bundle as the effective lengths of the end portions are being reduced. A one-way braking mechanism holds the torque member against undesired rotation opposite to the winding sense.

17 Claims, 8 Drawing Figures

BUNDLING APPARATUS WITH FLEXIBLE ROPE TYPE COMPRESSOR

BACKGROUND OF THE INVENTION

The present invention relates generally to garden implements and more particularly to an apparatus for bundling severed tree branches, shrubs and similar elongated elements.

It is well known to home owners and other real estate owners that, quite frequently, trees, shrubs and other plants have to be pruned or cut. When this happens, the owner is faced with the problem of disposing of the severed branches or other elongated elements. Often, the refuse collection personnel is under no obligation to remove such branches and the like unless they are properly prepared for collection, that is, bagged or tightly bundled. Yet, bundling of such elements, as advantageous as it is in many respects, presents a particularly difficult problem, since these elements are usually unwieldy, due to the presence of leaves, side branches or the like, so that it is not easy to place tying strings around a plurality of such elongated elements and to tighten such strings prior to tying.

A similar problem has been previously encountered in agriculture in connection with the formation of shocks from cereal grass and similar stalks, as evidenced, for instance, by the U.S. Pat. Nos. 521,088; 906,147; 1,000,533; 1,005,994; and 1,462,817. However, it has been established that the arrangements of these patents, as advantageous as they may be for forming shocks, are not suited for use for bundling severed branches and similar garden debris or the like, in that they require the placement of the elongated element, such as a rope, which performs the actual compression, all the way around the plurality of elongated elements to be bundled. This may be accomplished rather easily when such elongated elements are cereal grass stalks. However, this task would be very difficult if not impossible to accomplish in connection with a plurality of severed branches and similar garden debris, because of the generally irregular shapes of such elements to be bundled. Moreover, more often than not, where the known bundling arrangements include bundling members having free ends which are to be tied or otherwise connected to a support, the connecting locations are situated at very inconvenient or difficult to reach places.

Moreover, there are already known various constructions of brakes, among them ratchet-type or other one-way or freewheeling type brakes. One brake construction which employs a braking belt that is wrapped about a rotatable braking drum is disclosed in the U.S. Pat. No. 1,180,045. However, this brake is not a one-way brake; rather, it has to be actuated by the operator whenever it is desired to apply or release such a brake. Therefore, a brake of this type is not suited for use in applications where a freewheeling braking action is called for.

SUMMARY OF THE INVENTION

Accordingly, it is a general object of the present invention to avoid the disadvantages of the prior art.

More particularly, it is an object of the present invention to provide a bundling apparatus which does not possess the disadvantages of the known arrangements of this kind.

Still another object of the present invention is so to design the arrangement of the type here under consideration as to simplify the bundling operation and make it easy to accomplish even when the elements to be bundled have highly irregular shapes.

It is yet another object of the present invention to devise an apparatus of the above type which is particularly suited for the bundling or severed branches and similar garden or household debris.

A concomitant object of the present invention is so to construct the arrangement of the above type as to be relatively simple in construction, inexpensive to manufacture, easy to use, and reliable in operation nevertheless.

In keeping with these objects and others which will become apparent hereafter, one feature of the present invention resides in an arrangement for bundling elongated flexible elements. This arrangement comprises means for supporting a plurality of the elements to be bundled with substantially the same orientation. An elongated torque member is mounted on the supporting means for rotation about an axis and can be rotated by means of a hand crank mounted on the torque member for joint rotation therewith. The arrangement further includes at least one elongated flexible bundling member having two end portions with effective lengths that are at least sufficient for the end portions jointly to surround the plurality of the elements to be bundled, and a central portion interconnecting the end portions and connected to the torque member for becoming wound around the torque member during the rotation thereof with attendant simultaneous reduction in the effective lengths of the end portions, and means for connecting the end portions of the bundling rope with one another for the end portions to compress the elements into a compact bundle as the effective lengths of the end portions are being reduced.

A particular advantage of the arrangement as described so far is that the connecting means which connects the end portions of the bundling member can be arranged at any convenient location, regardless of the construction of the supporting means. This is particularly advantageous when the supporting means includes a receptacle for receiving the elements to be bundled, and a base accommodating the torque tube, and when the receptacle and base have at least one opening for the passage of the end portions of the bundling member therethrough, since the connecting means can be arranged so as to be conveniently accessible from the exterior of the receptacle. Advantageously, the receptacle has a hopper-shaped configuration including at least two side walls which converge toward the base. It is particularly advantageous when the supporting means further includes at least two support members for supporting the base on the ground and when at least one of the support members is a wheel.

According to another aspect of the present invention, the receptacle has two side walls which are provided with respective suspending formations for suspending the end portions of the bundling member therefrom. The connecting means advantageously includes an eyelet and a hook respectively secured to one and the other end portion of the bundling member and engageable with one another, and the formations are configured for engagement with the eyelet and with the hook, respectively.

It is further advantageous when the torque member has an outer circumferential surface and at least one aperture extending therethrough to open on circumferentially spaced regions of the circumferential surface and receiving a section of the central portion of the bundling member. In this context, it is currently preferred for the aperture to receive the section of the central portion of the bundling member loosely to permit the bundling member to slide in the passage for adjusting the lengths of the end portions of the bundling member relative to one another. It is also advantageous when the bundling member is a rope and when the torque member is tubular.

The present invention is also directed to a oneway braking arrangement for holding a rotatable member mounted on a support and having an outer circumferential surface in position against rotation in one sense while permitting substantially unimpeded rotation in the opposite sense. According to the present invention, this braking arrangement comprises a resilient braking crank member mounted on the support for pivoting between a braking and a releasing position and including an eccentric crank portion; and an elongated flexible braking member having a central portion surrounding the circumferential surface in a plurality of convolutions, one end portion secured to the support, and another end portion connected to the crank portion for the resilient braking crank member to elastically yield in response to rotation of the rotatable member in the opposite sense with attendant loosening of the convolutions and substantially unimpeded rotation of the rotatable member relative to the convolutions, and for the one end portion of the braking member to tighten the convolutions in response to rotation of the rotatable member in the one sense with attendant braking of the rotatable member. The braking member is advantageously constituted by a rope.

The novel features which are considered as characteristic of the invention are set forth in particular in the appended claims. The improved bundling apparatus itself, however, both as to its construction and its mode of operation, together with additional features and advantages thereof, will be best understood upon perusal of the following detailed description of specific embodiments with reference to the accompanying drawing.

DETAILED DESCRIPTION OF THE PREFERRED EMBODIMENTS

Figure 1:
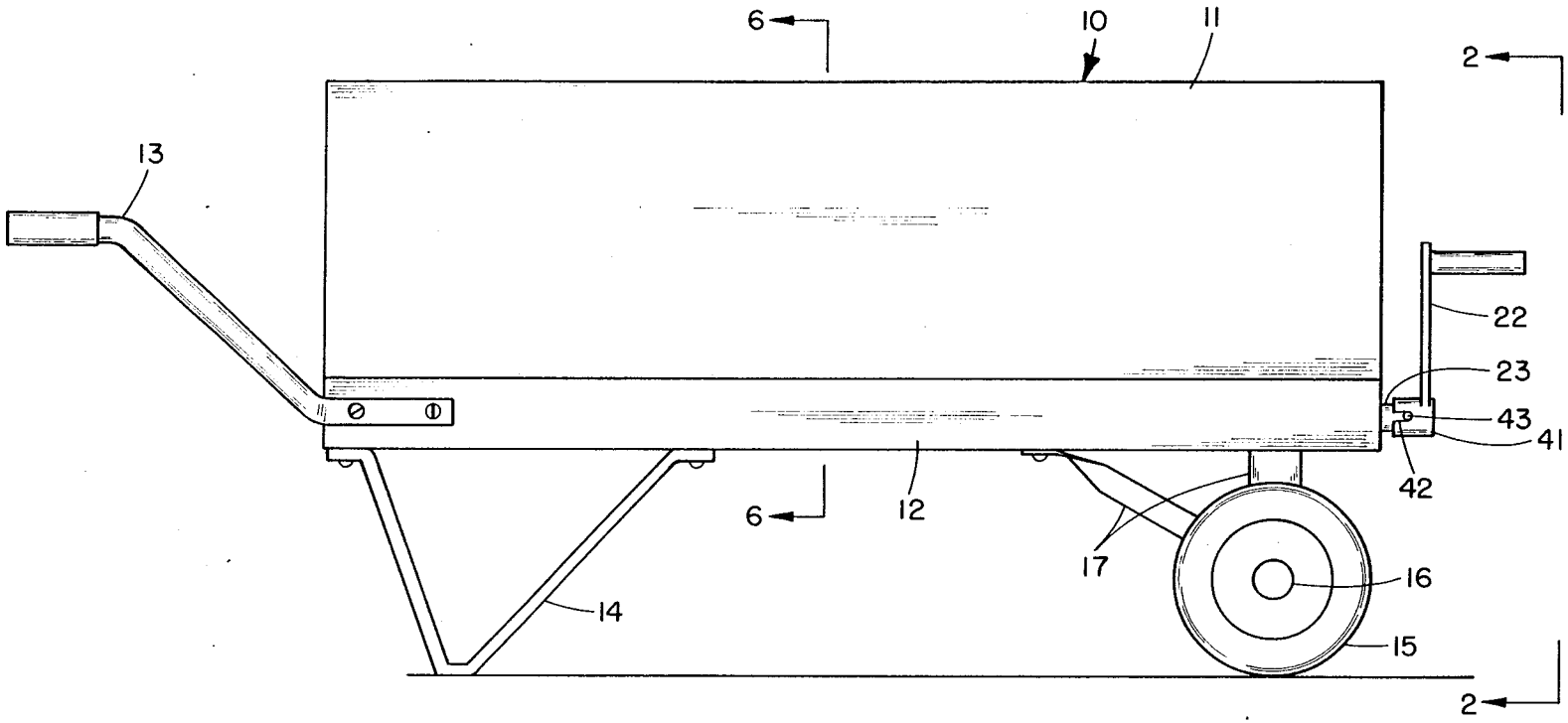
FIG. 1 is a side elevational view of the bundling apparatus according to the present invention.

Referring now to the drawing in detail, and first to FIG. 1 thereof, it may be seen that the reference numeral 10 has been used therein to identify a bundling apparatus according to the present invention in its entirety. The bundling apparatus 10 includes an upwardly open, substantially hopper-shaped receptacle 11 which is mounted on and extends upwardly from a base 12. The base 12 has a pair of handles 13 (only one shown in FIG. 1) mounted at one of its ends (hereafter referred-to as the rear end). A substantially V-shaped support member 14, or a plurality of such support members 14, is mounted at the rear end of the base 12, extending downwardly therefrom, to support the base 12 at an elevation above ground. The other end (hereafter referred to as the front end) of the base 12 is supported substantially at the same elevation above ground as the rear end on two wheels 15 which are mounted for rotation about an axle 16 by means of a mounting arrangement 17 which is secured to the base 12. Due to the presence of the wheels 15 and of the handles 13, the apparatus 10 can be easily moved from one location to another. Then, at any chosen location, the apparatus 10 assumes a stable position due to the support thereof on the wheels 15 and on the support members 14.

Figure 2:
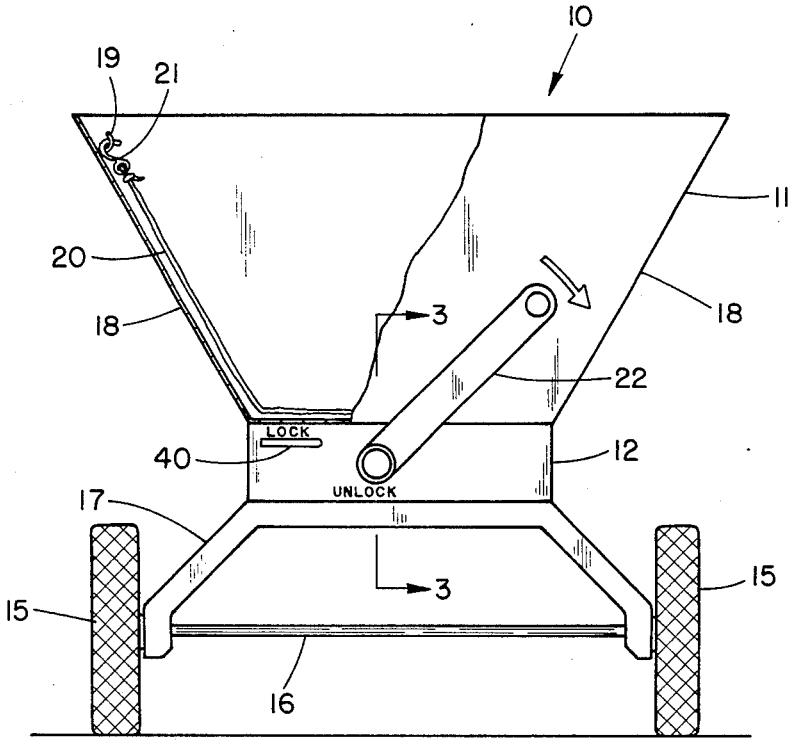
FIG. 2 is a front end view of the apparatus of the present invention taken on line 2—2 of FIG. 1.

As shown particularly in FIG. 2 of the drawing, the receptacle 11 diverges in the upward direction and is open at its upper end, while its lower end is closed by the base 12. The receptacle 11 is laterally bounded by two side walls 18. Each of the side walls 18 carries at its upper region at least one hook or a similar projecting or recessed formation 19 for the suspension of various elongated flexible elements used during the operation of the bundling apparatus 10 therefrom. Such elements to be suspended from the formation 19 include, for instance, a bundling rope 20. The bundling rope 20 is provided at one of its ends with a hook 21 which engages the formation 19 to suspend the associated end portion of the bundling rope 20 from the formation 19.

A hand crank 22 is mounted on a torque tube 23 for joint rotation therewith about a longitudinal axis of the torque tube 23. The torque tube 23 projects from the base 12, and the hand crank 22 is arranged, at one of the ends, as illustrated at the front end, of the base 12. It will be appreciated that the angular displacement of the hand crank 22 about the longitudinal axis of the torque tube 23 will result in commensurate rotation of the torque tube 23 about such axis.

Figure 3:
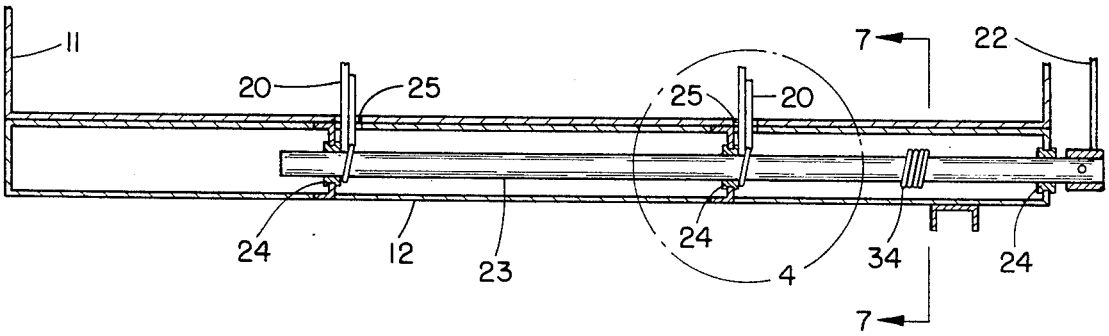
FIG. 3 is a partial sectional view taken on line 3—3 of FIG. 2.

As shown particularly in FIG. 3 of the drawing, the torque tube 23 is rotatably supported in the base 12 by means of respective bearings 24. In the illustrated construction, the torque tube cooperates in a manner which will be discussed in more detail below, with two bundling ropes 20 which are axially spaced from one another. While more or less than two such bundling ropes 20 can be used, the present invention will be explained with reference to only one such bundling rope 20 and it is to be understood that other bundling ropes 20, if any, will be arranged and will function in a similar or identical manner as the particularly discussed bundling rope 20.

Figure 4:
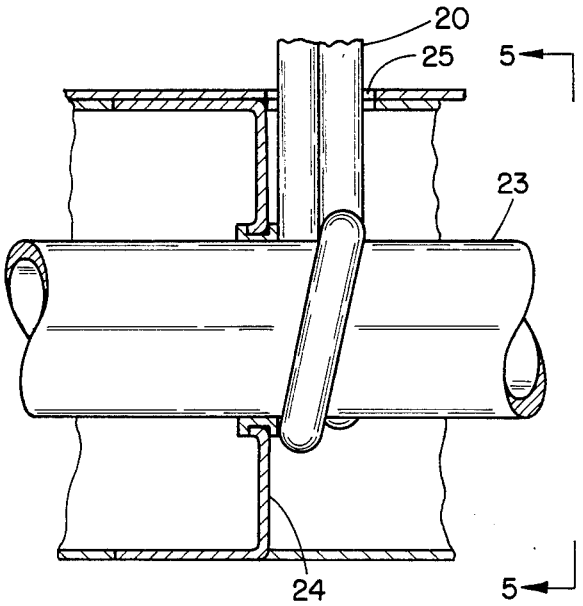
FIG. 4 is an enlarged sectional view of a detail 4 of FIG. 3.

The bundling rope 20 extends from the interior of the receptacle 11 into the interior of the base 12 through an opening 25. The portion of the bundling rope 20 which is received in the interior of the base 12 is wound around the torque tube 23, as shown particularly in FIGS. 4 and 5 of the drawing. The torque tube 23 is provided with two diametrically opposite apertures 26 and 27 through which the bundling rope 20 passes from one to the diametrically opposite section of the outer circumferential surface of the torque tube 23.

Figure 5:
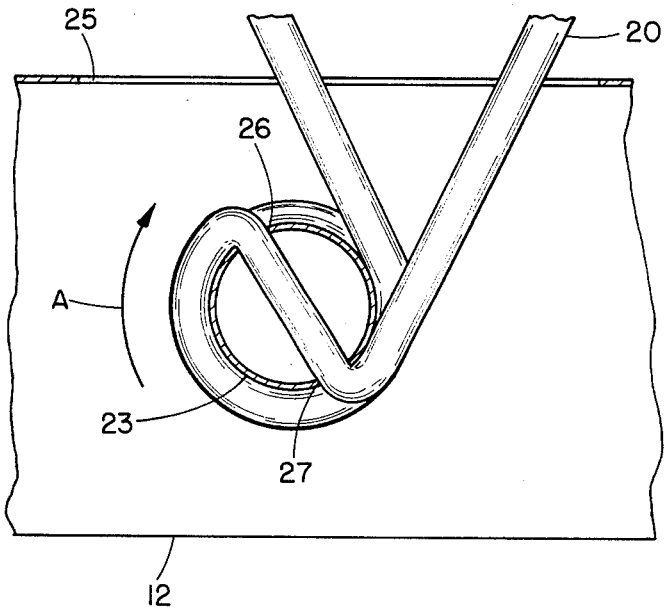
FIG. 5 is a cross-sectional view taken on line 5—5 of FIG. 4.

When the torque tube 23 is rotated by means of the handle 22 in the direction indicated by an arrow A in FIG. 5, the bundling rope 20 becomes wound more and more around the outer circumferential surface of the torque tube 23, forming successive convolutions on such surface. In this manner, the effective length of bundling rope 20, that is, the length which extends into the receptacle 11, can be shortened as desired. On the other hand, by causing the torque tube 23 to rotate oppositely to the arrow A, the successive convolutions of the bundling rope 20 are gradually unwound from the torque tube 23, so that the bundling rope 20 can be withdrawn from the interior of the base 12 into the interior of the receptacle 11 by pulling on the two ends of the bundling rope 20. When the bundling rope 20 is completely unwound from the torque tube 23, it is possible to change the relative length of the two end portions of the bundling rope 20 by pulling on one and not on the other of such end portions.

Figure 6:
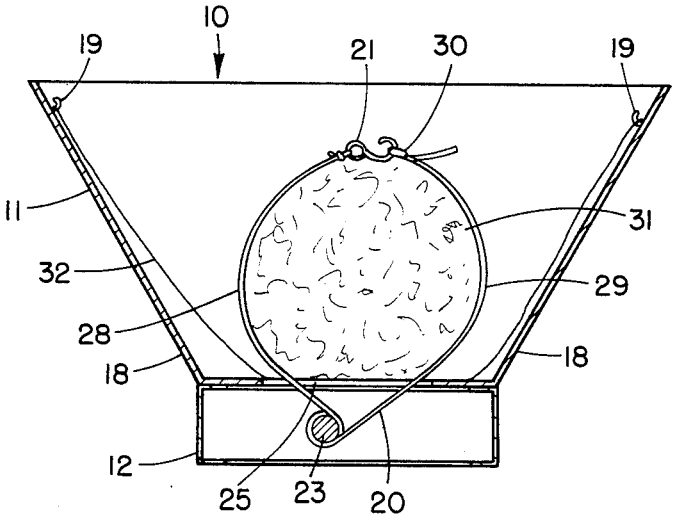
FIG. 6 is a cross-sectional view taken on line 6—6 of FIG. 1 during the bundling operation of the apparatus.

Having so described the construction of the bundling apparatus 10 of the present invention, its operation will now be discussed in some detail with reference to FIG. 6 of the drawing. As mentioned above, the bundling rope 20 has two end portions extending into the interior of the receptacle 11, these end portions being identified in FIG. 6 by reference numerals 28 and 29, respectively. The end portion 28 has the aforementioned hook 21 secured thereto, while the end portion 29 of the bundling rope 20 is provided with an eyelet 30 for engagement with the hook 21. The eyelet 30 may be constituted by a metallic or other relatively rigid material attachment of the bundling rope 20. However, it is also possible and actually currently preferred for the sake of simplicity and convenience to provide the eyelet as a section of the end portion 29 of the bundling rope 20 which is tied into a simple slip knot.

Prior to the use of the apparatus 10, at least one tying string 32 is so arranged in the interior of the receptacle 11 as to substantially hug the internal surfaces thereof, including those of the two side walls 18 and that of the bottom wall of the receptacle 11. As shown, the ends of the tying string 32 are connected to the formations 19. Also before the commencement of the bundling operation of the apparatus 10, the end portions 28 and 29 of the bundling rope 20 are suspended from the formations 19 as well.

After the bundling apparatus 10 has been prepared in the above manner for the bundling operation, such operation can commence. Elongated flexible and compressible elements, such as branches or other similar garden or household debris are put into the hopper-shaped receptacle 11 in such a manner that their main longitudinal axes extend substantially in the front-to-rear direction of the apparatus 10. Due to the hopper-shaped or downwardly converging configuration of the receptacle 11, the elongated elements to be bundled are partially pre-compressed as they settle under the influence of gravity at the bottom of the receptacle 11, to form a body 31 of such pre-compressed elongated elements. The hopper shape of the receptacle 11 is particularly advantageous since it enables the elongated elements to be bundled to settle in an organized and orderly fashion which is conducive to the eventual bundling thereof.

Once a sufficient number of the elongated elements to be bundled has been accumulated in the receptacle 11, the hook 21 and the eyelet 30 are disengaged from the respective formations 19 and are engaged with one another. It may be seen that, because of the provision of the hook 21 and the eyelet 30 which together form a buckle-type connecting device, the bundling rope 20 does not interfere in any manner with the filling of the receptacle 11 with the elongated elements to be bundled. Moreover, since the relative lengths of the end portions 28 and 29 can be changed as desired prior to the commencement of the bundling operation, it is possible to move the connecting device 21, 30 to any location that is convenient and/or easily accessible to the user of the bundling apparatus 10. When the eyelet 30 is formed, as mentioned before, simply by a section of the end portion 29 of the bundling rope 20, the bundling rope 20 can be pre-tightened by the user by passing the end portion 29 through the hook 21 and then pulling on the free end of the end portion 29 to pre-tighten the loop formed by the rope 20 in a noose-like fashion prior to tying the knot thereon to form the eyelet 30.

After the engagement of the hook 21 with the eyelet 30, the torque tube 23 is rotated by means of the hand crank 22, so that the bundling rope 20 is wound around the torque tube 23 and the effective lengths of the end portions 28 and 29 of the bundling rope 20 are reduced, with attendant further compression or bundling of the body 31 of the elongated elements. In this respect, it is particularly advantageous when the torque tube 23 is supported in its bearings 24 for at least limited axial displacement so that, during the rotation of the torque tube 23 in the winding sense, the convolutions of the bundling rope 20 which are gradually formed on the outer circumferential surface of the torque tube 23 cause gradual axial displacement of the torque tube 23, so that such convolutions are formed in an orderly fashion next to one another.

When the desired degree of compression of the body 31 is achieved, the ends of the tying string 32 are disengaged from the respective formations 19 and tied to one another so as to maintain the body 31 in its compressed state. Then, the torque tube 23 may be let or caused to rotate in the opposite sense, so that the end portions 28 and 29 of the bundling rope 20 become loose and the hook 21 and eyelet 30 can be disengaged from each other and engaged again with the respective formations 19. Thereafter, the tied bundle or body 31 can be removed from the receptacle 11, possibly after the apparatus 10 has been moved on the wheels 15 from one location to another, new tying strings 32 may be placed into the receptacle 11, and the abovediscussed bundling operation can be repeated with additional elongated elements to be bundled.

Figure 8:
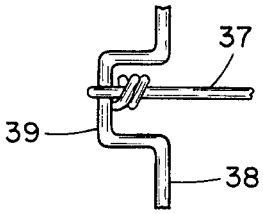
FIG. 8 is a view of a detail of FIG. 7 taken on line 8—8.
Figure 7:
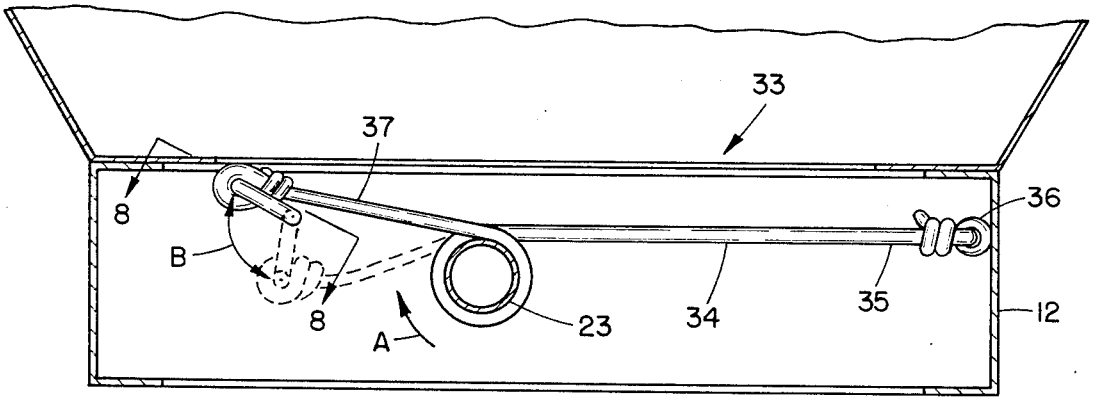
FIG. 7 is an enlarged cross-sectional view taken on line 7—7 of FIG. 3.

To prevent the bundling rope 20 from accidentally unwinding from the torque tube 23, there is provided a one-way or freewheeling braking mechanism 33 which is shown particularly in FIGS. 7 and 8 of the drawing. The braking mechanism 33 includes a braking rope 34 which is wound in several convolutions around the torque tube 23. The braking rope 34 has one end portion 35 connected to the base 12 at 36, and another end portion 37 which is connected to an eccentric crank portion 39 of a crank element 38.

The crank element 38 can be angularly displaced in the directions indicated by a double-headed arrow B in FIG. 7 between its braking position shown in solid lines, in which the braking rope 34 is substantially taut, and its releasing position in which the braking rope 34 is slack. The crank element 38 is slightly resilient so that, when the torque tube 23 is rotated in the direction of the arrow A, as it is during the tightening of the bundling rope 20, the crank element 38 will slightly resiliently yield when the crank element 38 is in its braking position, thus introducing into the braking rope 34 a slight degree of slack sufficient to let the torque tube 23 rotate substantially freely in the direction of the arrow A despite the fact that the crank element 38 is in its braking position. On the other hand, whenever the torque tube 23 has a tendency to rotate oppositely to the direction of the arrow A, such as under the pull of the bundling rope 20, and the crank element 38 is still in its braking position the slight slack of the braking rope 34 disappears because of the reversal of the direction of the friction forces with which the torque tube 23 acts on the braking rope 34, so that the braking rope 34 prevents the torque tube 23 from rotating opposite to the direction of the arrow A. Of course, when the crank element 38 is in its releasing position, the torque tube 38 is free to rotate in both senses without any impediment from the braking mechanism 33.

The crank element 38 is connected to a locking handle 40 which is arranged, as shown in FIG. 2 of the drawing, at the front end of the base 12 next to the hand crank 22, and which is movable between its locking and unlocking positions which correspond to the braking and releasing positions of the crank element 38, respectively.

Especially when the torque tube 23 is provided with, or cooperates with, the one-way braking mechanism 33, the hand crank 22 may be mounted on the torque tube 23 for easy removal but for secure rotational entrainment in a plurality of angularly displaced positions of the hand crank 22 on the torque tube 23. This can be accomplished in a particularly simple manner shown in FIG. 1 of the drawing when the hand crank 22 is provided with a hub 41 which has a plurality of circumferentially distributed slots 42 each of which has one open end, and when the end portion of the torque tube 23 which projects frontwardly out of the base 12 carries at least one projection 43, such as an interference-fitted pin, which is received in one, or in two diametrically oppositely arranged ones, of the slots 42. In this case, the rotation of the torque tube 23 can be accomplished by moving the hand crank 22 in a rocking motion, rather than in an orbiting motion, with intervening disengagement of the projection 43 from the hub 41 by axial displacement of the hand crank 22 until the projection 43 leaves the respective open-ended slot 42. If the section of the torque tube 23 which supports the hub 41 is long enough, it is not even necessary to remove the hand crank 22 from the torque tube during the intervening intervals of disengagement.

Of course, inasmuch as the bundling apparatus 10 of the present invention has the basic components of a wheelbarrow, that is, the hopper-shaped receptacle 11, the base 12, the handles 13, the support members 14 and the wheels 15, it can also be used, when not employed for bundling, for hauling objects, especially such of considerable dimensions and/or weight, from one location to another. In this case, the bundling rope 20 can be used under some circumstances for securing such objects to the apparatus 10 so as to prevent them from falling off. However, care must be taken, for instance by providing a false bottom or a liner, to prevent penetration of particulate or liquid substances through the openings 25 into the interior of the base 12, where they could damage or interfere with the operation of the bundling rope 20 and/or the torque tube 23.

It will be understood that each of the elements described above, or two or more together, may also find a useful application in other types of arrangements differing from the type described above.

While the invention has been illustrated and described as embodied in a bundling apparatus for branches and similar garden debris, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. An arrangement for bundling elongated flexible elements, comprising means for supporting a plurality of the elements to be bundled with substantially the same orientation;

an elongated torque member mounted on said supporting means for rotation about an axis;

means for rotating said torque member, including a hand crank mounted on said torque member for joint rotation therewith;

at least one elongated flexible bundling member having two end portions with effective lengths that are at least sufficient for said end portions jointly to surround said plurality of the elements to be bundled, and a central portion interconnecting said end portions and connected to said torque member for becoming wound around said torque member during the rotation thereof with attendant simultaneous reduction in said effective lengths of said end portions; and means for connecting said end portions of said bundling rope with one another for said end portions to compress said elements into a compact bundle as said effective lengths of said end portions are being reduced.

2. The arrangement as defined in claim 1, wherein said supporting means includes a receptacle for receiving said elements to be bundled, and a base accommodating said torque member; and wherein said receptacle and base have at least one opening for the passage of said end portions of said bundling member therethrough.

3. The arrangement as defined in claim 2, wherein said receptacle has a hopper-shaped configuration including at least two side walls which converge toward said base.

4. The arrangement as defined in claim 2, wherein said supporting means further includes at least two support members for supporting said base on the ground.

5. The arrangement as defined in claim 4, wherein at least one of said support members is a wheel.

6. The arrangement as defined in claim 2, wherein said receptacle has two side walls; and further comprising suspending formations on said side walls for suspending said end portions of said bundling member therefrom.

7. The arrangement as defined in claim 6, wherein said connecting means includes an eyelet and a hook respectively secured to one and the other of said bundling member and engageable with one another; and wherein said formations are configured for engagement with said eyelet and with said hook, respectively.

8. The arrangement as defined in claim 1, wherein said connecting means includes an eyelet and a hook respectively secured to one and the other of said end portions of said bundling member and engageable with one another.

9. The arrangement as defined in claim 1, wherein said torque member has an outer circumferential surface and at least one aperture extending therethrough to open on circumferentially spaced regions of said surface and receiving a section of said central portion of said bundling member.

10. The arrangement as defined in claim 9, wherein said aperture receives said section of said central portion of said bundling member loosely to permit said bundling member to slide in said passage for adjusting the lengths of said end portions of said bundling member relative to one another.

11. The arrangement as defined in claim 1, wherein said bundling member is a rope.

12. The arrangement as defined in claim 1, wherein said torque member is tubular.

13. The arrangement as defined in claim 1, and further comprising one-way braking means for holding said torque member in position against rotation in an unwinding sense while permitting substantially unimpeded rotation in a winding sense.

14. The arrangement as defined in claim 13, wherein said torque member has an outer circumferential surface; and wherein said braking means includes a resilient braking crank member mounted on said support for pivoting between a braking and a releasing position and including an eccentric crank portion, and an elongated flexible braking member having a central portion surrounding said circumferential surface in a plurality of convolutions, one end portion secured to said support, and another end portion connected to said crank portion for said resilient braking crank member to elastically yield in response to rotation of said torque member in said winding sense with attendant loosening of said convolutions and substantially unimpeded rotation of said torque member relative to said convolutions, and for said one end portion of said braking member to tighten said convolutions around said circumferential surface in response to rotation of said torque member in said unwinding sense with attendant braking of said torque member.

15. The arrangement as defined in claim 14, wherein said braking member is a rope.

16. A one-way braking arrangement for holding a rotatable member mounted on a support and having an outer circumferential surface in position against rotation in one sense while permitting substantially unimpeded rotation in the opposite sense, comprising a resilient braking crank member mounted on the support for pivoting between a braking and a releasing position and including an eccentric crank portion; and an elongated flexible braking member having a central portion surrounding the circumferential surface in a plurality of convolutions, one end portion secured to the support, and another end portion connected to said crank portion for said resilient braking crank member to elastically yield in response to rotation of the rotatable member in the opposite sense with attendant loosening of said convolutions and substantially unimpeded rotation of the rotatable member relative to said convolutions, and for said one end portion of said braking member to tighten said convolutions in response to rotation of the rotatable member in the one sense with attendant braking of the rotatable member.

17. The arrangement as defined in claim 16, wherein said braking member is a rope.

* * * * *